US011814914B1

(12) United States Patent
Wai

(10) Patent No.: US 11,814,914 B1
(45) Date of Patent: Nov. 14, 2023

(54) DOWNHOLE TRACTOR DRIVE MODULE

(71) Applicant: Halliburton Energy Services, Inc., Houston, TX (US)

(72) Inventor: Simon Whye Kwong Wai, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/842,437

(22) Filed: Jun. 16, 2022

(51) Int. Cl.
*E21B 23/00* (2006.01)

(52) U.S. Cl.
CPC ..... *E21B 23/001* (2020.05); *E21B 23/00* (2013.01)

(58) Field of Classification Search
CPC ..... E21B 23/001; E21B 23/00
See application file for complete search history.

(56) References Cited

U.S. PATENT DOCUMENTS

| | | | | |
|---|---|---|---|---|
| 6,273,189 | B1 * | 8/2001 | Gissler | E21B 4/04 166/241.1 |
| 6,722,442 | B2 | 4/2004 | Simpson | |
| 9,890,602 | B2 | 2/2018 | Guttormsen et al. | |
| 2005/0145415 | A1 * | 7/2005 | Doering | E21B 4/18 175/24 |
| 2006/0046889 | A1 * | 3/2006 | Christensen | H02K 7/116 475/170 |
| 2008/0110287 | A1 * | 5/2008 | Schonlau | B25J 9/1025 74/457 |
| 2008/0245258 | A1 * | 10/2008 | Herron | F16L 55/32 104/138.2 |
| 2015/0300113 | A1 * | 10/2015 | Guttormsen | E21B 4/18 166/243 |
| 2016/0024848 | A1 * | 1/2016 | Desmette | E21B 17/1078 175/74 |
| 2019/0040698 | A1 * | 2/2019 | Fuglestad | E21B 23/14 |
| 2019/0048976 | A1 | 2/2019 | Armstrong | |
| 2019/0234503 | A1 | 8/2019 | Shahipassand et al. | |
| 2020/0157886 | A1 * | 5/2020 | Fuglestad | E21B 4/18 |

FOREIGN PATENT DOCUMENTS

| | | | | |
|---|---|---|---|---|
| WO | WO-0073619 | A1 * | 12/2000 | E21B 23/10 |
| WO | WO-0166976 | A1 * | 9/2001 | F16H 49/001 |
| WO | 2014081305 | A1 | 5/2014 | |

OTHER PUBLICATIONS

International Search Report and Written Opinion for International Patent Application No. PCT/US2022/034859 dated Mar. 17, 2023.

* cited by examiner

*Primary Examiner* — James G Sayre
(74) *Attorney, Agent, or Firm* — John W. Wustenberg; C. Tumey Law Group PLLC

(57) ABSTRACT

Systems and methods of the present disclosure relates to propelling downhole tractors in wellbores. A downhole tractor drive module comprises an output shaft; a harmonic drive gear driven by the output shaft; and at least one wheel, wherein the harmonic drive gear is operable to control torque supplied to the at least one wheel.

20 Claims, 4 Drawing Sheets

DOWNHOLE TRACTOR DRIVE MODULE

BACKGROUND

Subterranean propulsion devices, such as downhole tractors, facilitate moving wireline assemblies into a wellbore. The tractors are designed to contact walls of the wellbore, to navigate the tractor and any portions of pipe or wireline tools in the wellbore. The tractor receives electrical power from the surface via a wireline. The power is routed to an electric motor that is connected to a system of gears to drive traction wheels of the tractor.

Typically, these electromechanical tractors include drive modules to provide traction to propel the tractor forward. Each drive module has individual propulsion with a determined tractive force based on the motor capacity and the friction between the drive wheel and the casing wall. The traction wheels are driven by a drive train which typically includes an electric motor arranged along and parallel to the drive arm, an angular gearbox and a chain or belt drive to connect the angular gearbox to the wheels.

However, the drive train architecture causes the output torque on the chain drive to be high. And since there is limited space to accommodate a large chain; often, the chain will be undersized. As a result, fatigue failure is prevalent in such designs resulting in a broken chain.

BRIEF DESCRIPTION OF THE DRAWINGS

These drawings illustrate certain aspects of some examples of the present disclosure and should not be used to limit or define the disclosure.

DETAILED DESCRIPTION

Figure 1:
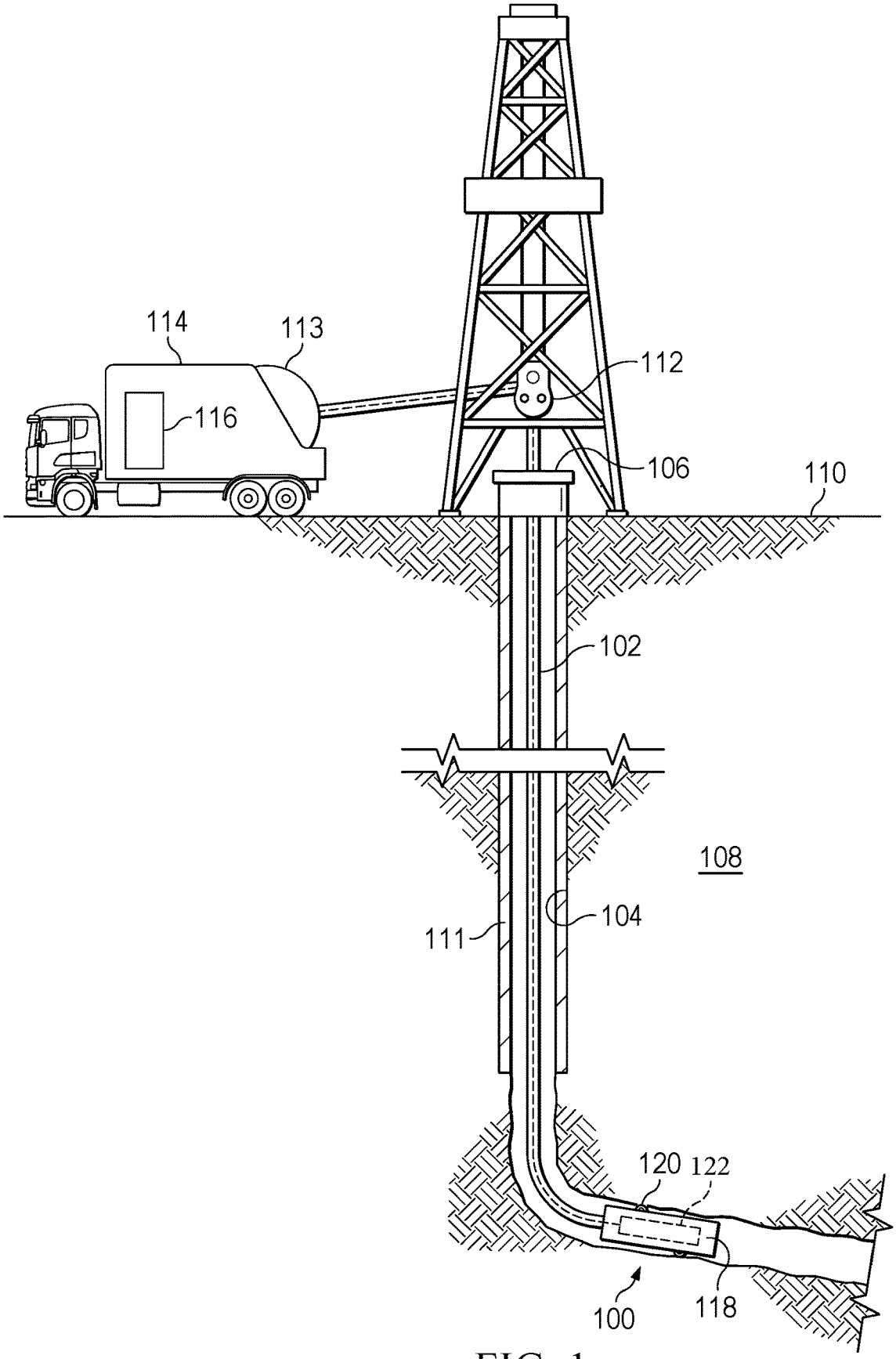
FIG. 1 illustrates an operating environment for a wireline tractor, in accordance with examples of the present disclosure.

The present disclosure relates generally to drive mechanisms for downhole (e.g., wireline) tractors. Specifically. a wireline tractor includes a drive module that includes drive train architecture that connects a tractor wheel directly to a harmonic drive gear. The harmonic drive gear is selected because it is a single stage high gear ratio component that is compact and has high torque capacity. With the harmonic drive gear, other drive components upstream will experience a much lower torque load and mitigate the risk of a fatigue failure resulting in a longer service life.

In particular examples, the drive module includes a drive wheel driven by a motor mounted outside the drive arm housing and arranged along and parallel with the drive arm. The wheel is connected to the motor via a drive train arrangement comprising a harmonic drive gear, a chain drive and an angular gear. The harmonic drive gear and chain drive are typically mounted within the drive arm and the angular gear mounted outside the drive arm.

The output shaft of the harmonic drive gear is directly connected to the drive wheel. An output shaft of the angular gear provides the input to the chain drive. The chain drive drives the sprocket which is mounted onto a harmonic drive gear. In some examples, the chain drive can be replaced with a belt drive or a series of spur/helical gears. In some examples, the drive module may include a motor housing that includes a motor that is in contact with a gearbox (e.g., offset gearbox). The gearbox may be in contact with an angular gearbox via a coupling. The angular gearbox may be in contact with a drive arm.

The drive arm may include an arm housing that may include at least one chain drive. The chain drive(s) are configured to rotate a wheel of the tractor as the motor rotates. The chain drive may rotate a harmonic drive gear. For example, the motor may rotate at least one gear in the gearbox which rotates a gear in the angular gearbox via the coupling.

The angular gear box may rotate an output shaft that is disposed in the arm housing. The chain drive may include the shaft, a chain, and sprockets. The output shaft may rotate the input sprocket causing the chain and output sprocket to rotate. The output sprocket may rotate the wheel via a harmonic drive gear. A hydraulic cylinder may be disposed between the motor housing and the drive arm. The hydraulic cylinder may extend and retract the drive arm such that the wheel contacts walls of the wellbore (e.g., casing).

The harmonic drive gear includes a rotating member such as a wave generator and multiple splines and may include other rotatable components. For example, the wave generator is in contact with a flex spline that is in contact with a circular spline. The gear ratio between the splines allows the wheel to rotate at a slower speed than the spline. The sprocket rotates the wave generator which rotates the flex spline within the circular spline.

A bearing (e.g., oval shaped) may be disposed against the wave generator. A cap may be disposed around the splines and the wave generator. An o-ring and a rotary seal may be disposed against the cap. A hub may be disposed around a portion of the cap, and an angular contact bearing may be disposed between a portion of the hub and the cap. A retainer may be disposed in the hub to secure the wheel to the hub. Further, the drive module may include a cover(s) to protect internal components.

During operation of the drive module, the output shaft rotates causing the input sprocket to rotate. Rotation of the input sprocket causes rotation of the output sprocket via the chain. The output sprocket rotates the wave generator. The wave generator rotates the flexible spline within the circular spline. The flex spline is attached to the hub. The hub is attached to the wheel. Thus, the flex spline rotates the wheel at a reduced speed relative to the output shaft due to the gear ratio therebetween (e.g., number of teeth).

FIG. 1 illustrates an operating environment for a wireline tractor, in accordance with examples of the present disclosure. It should be noted that while FIG. 1 generally depicts a land-based operation, those skilled in the art may recognize that the principles described herein are equally applicable to subsea operations that employ floating or sea-based platforms and rigs, without departing from the scope of the disclosure. The tractor 100 may be operatively coupled to a conveyance 102 (e.g., wireline). The conveyance 102 may provide electrical connectivity and mechanical suspension for the tractor 100. A wellbore 104 may extend from a wellhead 106 into a subterranean formation 108 from a surface 110. At least a portion of the wellbore 104 may include casing 111.

The tractor 100 may facilitate the conveyance of wireline assemblies into the wellbore 104. The tractor 100 is designed to contact walls of the wellbore (e.g., casing, pipe string or open hole) to move the tractor and any portion of pipe or tubing or wireline tools connected thereto. The tractor 100 receives electrical power from the surface via a wireline. The power is routed to an electric motor. Typically, the electric motor is connected to a system of gears to directly drive traction wheels 120, or the electric motor drives a hydraulic pump that in turn drives one or more hydraulic motors to drive the traction wheels. The drive assemblies may be fixed ratio systems such that a drive speed is directly proportional to the speed of the motor.

The wellbore 104 may include horizontal, vertical, slanted, curved, and other types of wellbore geometries and orientations. The conveyance 102 may be disposed around one or more sheave wheels 112 and a spool 113 disposed on a vehicle 114. The conveyance 102 may include a plurality of electrical conductors extending from vehicle 114. The electrical conductors may be used for communicating power and telemetry between vehicle 114 and tractor 100. Information from the tractor 100 may be gathered and/or processed by a computer 116. The computer 116 may also supply control signals and power to the tractor 100. For example, electrical and/or hydraulic power may be provided to various portions of the tractor 100.

The tractor 100 includes a tubular housing 118 and wheels 120 to allow the tractor 100 to move through the wellbore 104. The tubular housing 118 may be subdivided into various subs, that include one or more wheels. The wheels 120 may be disposed on opposing sides of the tractor 100. The wheels 120 may extend and retract to allow navigation through various sized wellbores. Although two wheels are illustrated, the tractor 100 may include more wheels, as appropriate. One or more wheels may be powered wheel assemblies for propelling the tractor 100 through the wellbore 104 in order to run the wireline into the wellbore 104.

In some examples, some wheels or wheel assemblies of the tractor 100 may not be powered but rather rotate freely during operation of the tractor 100. A drive module 122 disposed within the tractor 100 may power the tractor 100. For example, the drive module 122 may control rotation of at least one of the wheels 120. In some examples, a pair of wheels may be controlled by the drive module 122.

Figure 2:
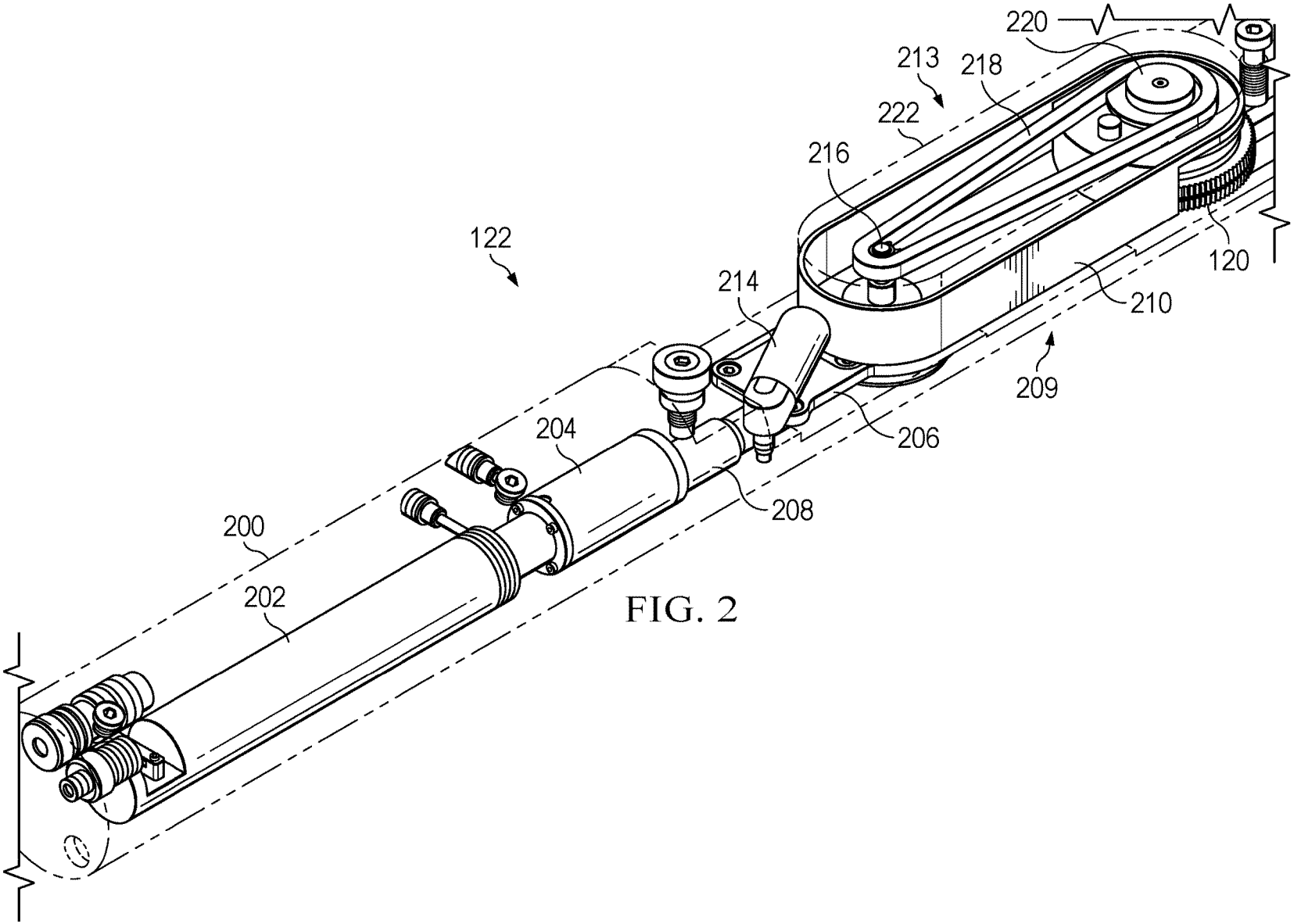
FIG. 2 illustrates an example of the drive module for the wireline tractor, in accordance with examples of the present disclosure.
Figure 3:
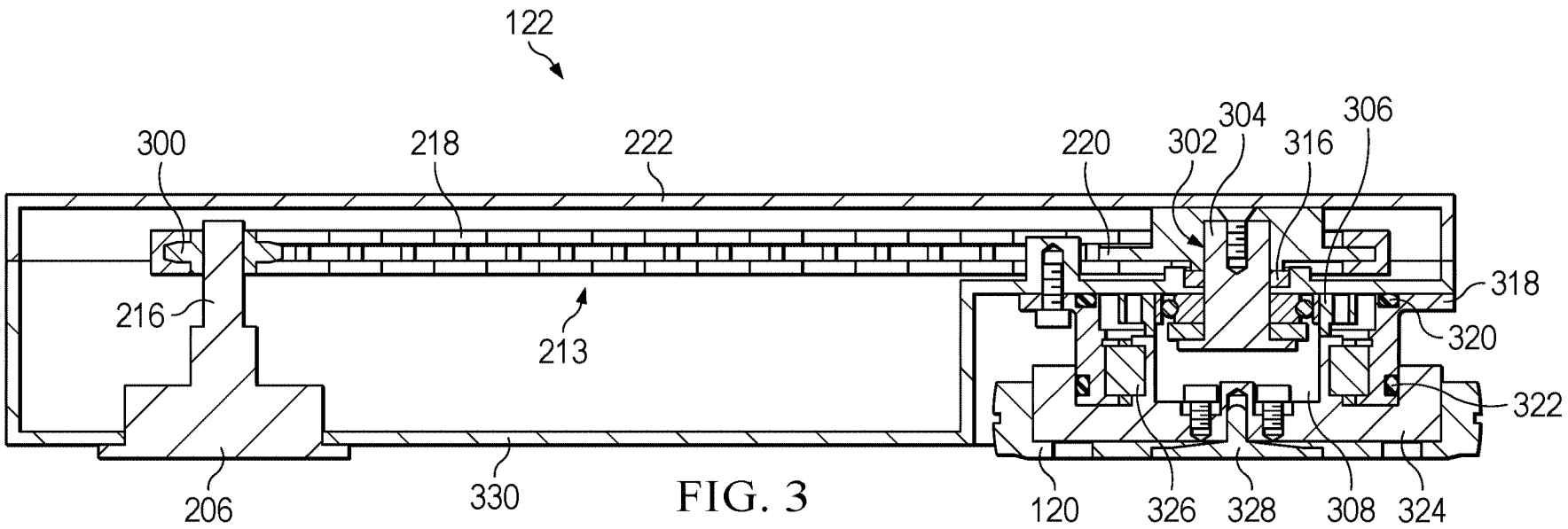
FIG. 3 illustrates a cross-sectional view of the drive module of FIG. 2, in accordance with examples of the present disclosure.

FIGS. 2 and 3 illustrate close-up views of the drive module 122 with a chain drive, in accordance with some examples of the present disclosure. FIG. 2 is a top perspective view of the drive module 122 while FIG. 3 is a cross-sectional side view of the drive module 122. The drive module 122 may include a motor housing 200 that includes a motor 202 that is in contact with a gearbox 204 (e.g., offset gearbox). The gearbox 204 may be in contact with an angular gearbox 206 via a coupling 208. The gearbox 206 may be in contact with a drive arm 209.

The drive arm 209 may include an arm housing 210 that may include a chain drive 213. The chain drive 213 is configured to rotate the wheel 120 as the motor 202 rotates. The chain drive 213 may rotate a harmonic drive gear. A hydraulic cylinder 214 may be disposed between the motor housing 200 and the drive arm 209. The hydraulic cylinder 214 may extend and retract the wheel 120.

The motor 202 may rotate at least one gear in the gearbox 204 which rotates a gear in the angular gearbox 206 via the coupling 208. The gear box 206 may rotate an output shaft 216 that is disposed in the arm housing 210. The chain drive 213 may include the shaft 216, a chain 218, and a sprocket 220. The output shaft 216 may rotate the chain 218 that rotates the sprocket 220. The sprocket 220 may rotate the wheel 120 via a harmonic drive gear.

The arm housing 210 may also include a cover 222 to protect the components therein. The motor 202 is mounted outside the arm housing 210 and arranged along and parallel with the arm housing 210. The wheel 120 is connected to the motor 202 via a drive train arrangement comprising a harmonic drive gear, a chain drive, and an angular gear. The harmonic drive gear and chain drive are mounted within the arm housing 210 and the angular gear is mounted outside the arm housing 210.

With additional reference to FIG. 3, the angular gearbox 206 rotates the output shaft 216 which rotates an input sprocket 300 to rotate the chain 218 (e.g., roller chain) which rotates the sprocket 220 (e.g., output sprocket). In some examples, the chain drive 213 can be replaced with a belt drive or a series of spur/helical gears.

The sprocket 220 rotates a harmonic drive gear 302. The harmonic drive gear 302 is selected because it is a single stage high gear ratio component that is compact and has high torque capacity. With the harmonic drive gear 302, other drive components upstream will experience a much lower torque load and mitigate the risk of a fatigue failure resulting in a longer service life.

The harmonic drive gear 302 includes a rotating member such as a wave generator 304 and multiple splines and may include other rotatable components. For example, the wave generator 304 is placed within a flex spine that is placed within a circular spline 306. The circular spline 306 is in contact with a flex spline 308. The flex spline 308 is shaped similar to a cup. The sides of the spline are thin, and the bottom is rigid to allow for flexibility of the walls at the open end due to the thin wall, and in the closed side being rigid enough to be tightly secured to a shaft, for example. Teeth may be positioned radially around the outside of the flex spline.

The flex spline 308 fits tightly over the wave generator 304. The circular spline 306 is a rigid circular ring with teeth on its inside. The flex spline 308 and the wave generator are placed inside the circular spline 306, meshing the teeth of the flex spline 308 and the circular spline 306. The gear ratio between the splines allows the wheel 120 to rotate at a slower speed than the spline 306. The sprocket 220 rotates the wave generator 304 and the flex spine 308.

As the wave generator 304 rotates, the flex spline teeth which are meshed with those of the circular spline 306 gradually change position. For every full rotation of the wave generator 304, the flex spline 308 would be required to rotate a slight amount backward relative to the circular spline 306. Thus, the rotation action of the wave generator 304 results in a much slower rotation of the flex spline 308 in the opposite direction. For example, when there are 102 teeth on the circular spline 306 and 100 on the flex spline 308, the reduction ratio is 100−102)/100=−0.02. Thus, the flex spline spins at 1/50 the speed of the wave generator 304 and in the opposite direction. Different reduction ratios may be achieved by changing the number of teeth.

A bearing 316 (e.g., oval shaped) may be disposed between the wave generator 304 and the flexible spline 308. The harmonic drive gear 302 is a type of mechanical gear system that uses a flexible spline with external teeth, which is deformed by rotating the elliptical/oval bearing. Teeth of the flexible spline 308 engage with the internal gear teeth of an outer spline. The elliptical bearing forces the bearing to conform to the elliptical shape but still allowing for rotation. This system allows for no backlash and high torque capability.

A cap 318 may be disposed around the splines and the wave generator 304. An o-ring 320 and a rotary seal 322 may be disposed against the cap 318. A hub 324 may be disposed around a portion of the cap 318, and an angular contact bearing 326 may be disposed between a portion of the hub 324 and the cap 318. A retainer 328 may be disposed in the hub 324 to secure the wheel 120 to the hub 324. Further, the drive module 122 includes a bottom cover 330 in addition to the cover 222 (top cover).

Figure 4:
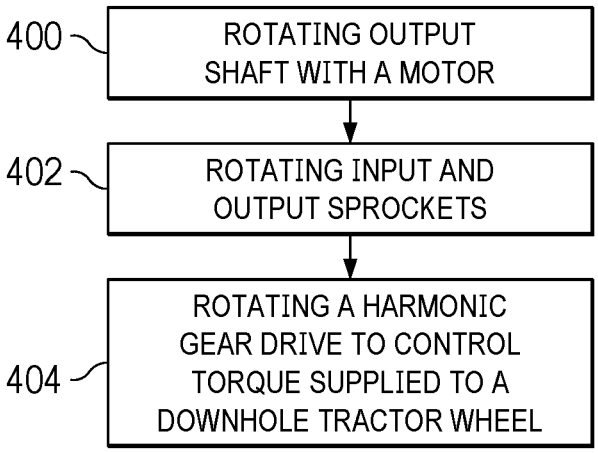
FIG. 4 illustrates an operative flow chart for the drive module, in accordance with examples of the present disclosure.

FIG. 4 illustrates an operative flow chart for the drive module 122, in accordance with examples of the present disclosure. At step 400, the output shaft 216 rotates, causing the input sprocket 300 to rotate. The motor 200 may drive the output shaft 216, as shown on FIGS. 2 and 3. Rotation of the input sprocket 300 causes rotation of the output sprocket 220 via the chain 218, at step 402.

The output sprocket 220 rotates the harmonic drive gear 302. That is, the wave generator 304 and the flex spline 308, at step 404 (shown on FIGS. 2 and 3). The wave generator 304 rotates the flex spline 308. The flex spline 308 is attached to the hub 324. The hub 324 is attached to the wheel 120. Thus, the flex spline 308 rotates the wheel 120 at a reduced speed relative to the output shaft 216 due to the gear ratio therebetween. The harmonic drive gear 302 controls torque supplied to the downhole tractor wheel(s) 120, as shown on FIGS. 1-3.

Accordingly, the systems and methods of the present disclosure use a harmonic drive gear in wireline tractor to reduce damage to internal components caused by excessive torque. The systems and methods may include any of the various features disclosed herein, including one or more of the following statements.

Statement 1. A downhole tractor drive module comprises an output shaft; a harmonic drive gear driven by the output shaft; and at least one wheel, wherein the harmonic drive gear is operable to control torque supplied to the at least one wheel.

Statement 2. The downhole tractor drive module of the statement 1, wherein the harmonic drive gear comprises a wave generator attached to a flex spline.

Statement 3. The downhole tractor drive module of the statement 1 or the statement 2, wherein the flex spline is attached to a hub for the at least one wheel.

Statement 4. The downhole tractor drive module of any one of the statements 1-3, further comprising sprockets to rotate the harmonic drive gear.

Statement 5. The downhole tractor drive module of any one of the statements 1-4, further comprising a chain coupling the sprockets.

Statement 6. The downhole tractor drive module of any one of the statements 1-5, further comprising an angular gear to rotate the output shaft.

Statement 7. The downhole tractor drive module of any one of the statements 1-6, wherein the at least one wheel is extendable or retractable.

Statement 8. A downhole tractor comprising: a harmonic drive gear; and at least one wheel, wherein the harmonic drive gear is operable to control torque supplied to the at least one wheel.

Statement 9. The downhole tractor of the statement 8, further comprising at least one chain drive or at least one belt drive operable to rotate the harmonic drive gear.

Statement 10. The downhole tractor of the statement 8 or 9, wherein the harmonic drive gear comprises a flex spline and a circular spline.

Statement 11. The downhole tractor of any one of the statements 8-10, wherein the flex spline is coupled to a hub for the at least one wheel.

Statement 12. The downhole tractor of any one of the statements 8-11, wherein the choke is moveable based on pressure within the tool.

Statement 13. The downhole tractor of any one of the statements 8-12, further comprising sprockets operable to rotate the harmonic drive via a chain or belt.

Statement 14. A method comprising: running a downhole tractor into a wellbore; and rotating a wheel of the tractor via a harmonic drive gear to control torque supplied to the wheel.

Statement 15. The method of the statement 14, further comprising rotating at least one chain drive or belt drive to rotate the harmonic drive gear.

Statement 16. The method of any one of the statements 14-15, wherein rotating the harmonic drive gear comprises rotating a wave generator and a flex spline, wherein the flex spline is attached to a hub for the wheel.

Statement 17. The method of any one of the statements 14-16, further comprising rotating at least one chain drive or belt drive with an output shaft driven by a motor of the tractor.

Statement 18. The method of any one of the statements 14-17, wherein the motor drives an angular gear to rotate the output shaft.

Statement 19. The method of any one of the statements 14-18, further comprising rotating sprockets to rotate the harmonic drive gear via the output shaft.

Statement 20. The method of any one of the statements 14-19, further comprising extending a drive arm of the tractor, wherein the harmonic drive gear is disposed in the drive arm.

Although the present disclosure and its advantages have been described in detail, it should be understood that various changes, substitutions and alterations may be made herein without departing from the spirit and scope of the disclosure as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A downhole tractor drive module comprising:

an arm housing including:

an output shaft;

a harmonic drive gear driven by the output shaft;

sprockets to rotate the harmonic drive gear;

a chain coupling the sprockets; and a wheel, wherein the harmonic drive gear is operable to control torque supplied to the wheel;

a motor housing including a motor and a gearbox configured to rotate the output shaft; and a hydraulic cylinder extending between the arm housing and the motor housing.

2. The downhole tractor drive module of claim 1, wherein the harmonic drive gear comprises a wave generator attached to a flex spline, wherein the sprockets comprise an input sprocket and an output sprocket, and wherein the input sprocket is coupled to the output sprocket via the chain.

3. The downhole tractor drive module of claim 2, wherein the flex spline is attached to a hub for the wheel.

4. The downhole tractor drive module of claim 3, wherein the output shaft is configured to rotate the input sprocket that causes the chain and the output sprocket to rotate, and wherein the output sprocket is configured to rotate the wheel via the harmonic drive gear.

5. The downhole tractor drive module of claim 2, wherein rotation of the output shaft causes the input sprocket to rotate, wherein rotation of the input sprocket causes rotation of the output sprocket via the chain, and wherein the output sprocket is configured to rotate the wave generator.

6. The downhole tractor drive module of claim 1, further comprising an angular gearbox coupled to the gearbox to rotate the output shaft.

7. The downhole tractor drive module of claim 1, wherein the wheel is extendable and retractable via the hydraulic cylinder and a drive arm comprising the arm housing, and wherein a downhole tractor comprises multiple wheels comprising the wheel.

8. A downhole tractor comprising:

an arm housing including:

a harmonic drive gear; and a wheel, wherein the harmonic drive gear is operable to control torque supplied to the wheel;

a motor housing including a motor and a gearbox configured to rotate the harmonic drive gear; and a hydraulic cylinder disposed between the arm housing and the motor housing wherein the hydraulic cylinder is configured to extend and retract a drive arm of the downhole tractor to extend and retract the wheel, wherein the drive arm comprises the arm housing.

9. The downhole tractor of claim 8, further comprising a chain drive or a belt drive operable to rotate the harmonic drive gear, wherein the motor and the gearbox are configured to rotate the chain drive or the belt drive to rotate the harmonic drive gear.

10. The downhole tractor of claim 8, wherein the harmonic drive gear comprises a flex spline and a circular spline.

11. The downhole tractor of claim 10, wherein the flex spline is coupled to a hub for the wheel, wherein rotation of the harmonic gear drive rotates the hub to rotate the wheel.

12. The downhole tractor of claim 8, further comprising sprockets operable to rotate the harmonic drive via a chain or belt, wherein the sprockets comprise an input sprocket and an output sprocket coupled via the chain or the belt, wherein the output shaft is configured to rotate the input sprocket, wherein rotation of the input sprocket rotates the output sprocket via the chain or the belt, and wherein rotation of the output sprocket rotates the harmonic gear drive to rotate the wheel.

13. The downhole tractor of claim 12, comprising an angular gearbox coupled to the gearbox and configured to rotate the output shaft, wherein the motor includes an electric motor, and wherein the motor is configured to rotate a gear in the gearbox that rotates a gear in the angular gearbox.

14. A method comprising:

running a downhole tractor into a wellbore, wherein the downhole tractor comprises:

an arm housing including a chain drive or a belt drive, a harmonic drive gear, and a wheel;

a motor housing including a motor and a gearbox; and a hydraulic cylinder extending between the arm housing and the motor housing; and rotating by the motor and the gearbox the chain drive or the belt drive to rotate the wheel via the harmonic drive gear, wherein the harmonic gear drive controls torque supplied to the wheel.

15. The method of claim 14, wherein rotating the chain drive or the belt drive rotates the harmonic drive gear.

16. The method of claim 15, wherein rotating the harmonic drive gear comprises rotating a wave generator and a flex spline of the harmonic drive gear, wherein the flex spline is attached to a hub for the wheel.

17. The method of claim 14, wherein rotating by the motor and the gearbox the chain drive or the belt drive comprises rotating by the motor and the gearbox an output shaft.

18. The method of claim 17, wherein the motor and the gearbox drive an angular gear to rotate the output shaft, and wherein the arm housing includes the chain drive comprising the output shaft or wherein the arm housing includes the belt drive comprising the output shaft.

19. The method of claim 17, further comprising rotating sprockets via the output shaft to rotate the harmonic drive gear, wherein the arm housing includes the chain drive comprising the sprockets or wherein the arm housing includes the belt drive comprising the sprockets.

20. The method of claim 19, further comprising extending the wheel via the hydraulic cylinder and a drive arm of the downhole tractor, the drive arm comprising the arm housing, wherein the sprockets comprise an input sprocket and an output sprocket, wherein the input sprocket is coupled to the output sprocket via the chain or the belt, wherein rotating the sprockets comprises rotating the input sprocket via the output shaft and rotating the output sprocket via the input sprocket and the chain or belt to rotate the harmonic drive gear thereby rotating the wheel.

* * * * *